United States Patent [19]

Taniguchi

[11] Patent Number: 4,643,498

[45] Date of Patent: Feb. 17, 1987

[54] ANISOTROPIC ELECTRIC CONDUCTIVE RUBBER CONNECTOR

[75] Inventor: Koki Taniguchi, Osaka, Japan

[73] Assignee: Sharp Kabushiki Kaisha, Osaka, Japan

[21] Appl. No.: 751,942

[22] Filed: Jul. 5, 1985

[30] Foreign Application Priority Data

Jul. 5, 1984 [JP] Japan ..... 59-102337[U]

[51] Int. Cl.[4] ..... H01R 9/09

[52] U.S. Cl. ..... 339/17 M; 339/DIG. 3

[58] Field of Search ..... 339/17 CF, 17 M, 17 LM, 339/17 R, 59 M, 61 M, DIG. 3

[56] References Cited

FOREIGN PATENT DOCUMENTS 3401956 7/1984 Fed. Rep. of Germany ... 339/17 M

OTHER PUBLICATIONS

SID International Symposium Digest of Technical Papers; Metal-Elastomer Display Connectors; pp. 64, 65; 5-1979.

*Primary Examiner*—Neil Abrams

*Attorney, Agent, or Firm*—Birch, Stewart, Kolasch and Birch

[57] ABSTRACT

An anisotropic electric conductive rubber is formed in a reversed L-shape and has integral horizontal and vertical portions. An insulating rubber is applied to the top of the horizontal portion or to the top of the horizontal portion and the outer side of the vertical portion so that a mounting angle is electrically insulated from the electric conductive rubber and that the anisotropic electric conductive rubber is protected from moisture and dust. Moreover, the insulating rubber is softer than the anisotropic electric conductive rubber. As a result, the connector as a whole is relatively soft so that it is hardly damaged and that precise dimension is easily obtained.

10 Claims, 6 Drawing Figures

FIG. 1
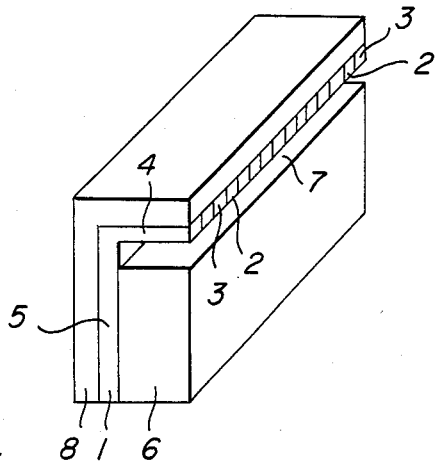
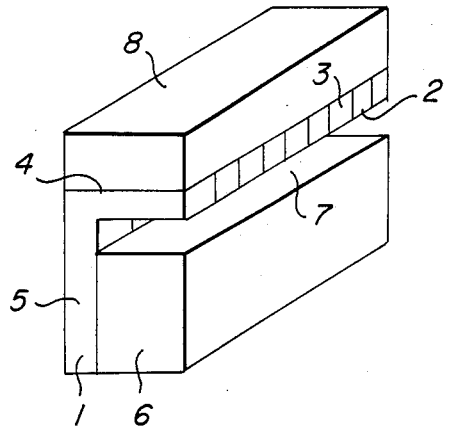
FIG. 2
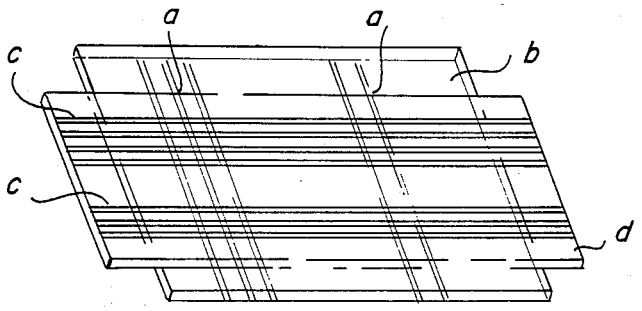
FIG. 4

ANISOTROPIC ELECTRIC CONDUCTIVE RUBBER CONNECTOR

BACKGROUND OF THE INVENTION

The present invention relates to an anisotropic electric conductive rubber connector used in mounting a display device such as an LCD on a printed circuit board. Conventionally, when a liquid crystal panel is mounted on the PC board, a glass on the common side is secured using an anisotropic electric conductive rubber connector. The conventionally available anisotropic electric conductive rubber connector, however, is not reliable enough to permit efficient mounting procedure of the display device.

SUMMARY OF THE INVENTION

Accordingly, the object of the present invention is to provide an anisotropic electric conductive rubber connector of a novel construction.

Briefly described, in accordance with the present invention, an anisotropic electric conductive rubber connector comprises an anisotropic electric conductive rubber of a reversed L-shaped section having vertical and horizontal portions, a first insulating rubber attached to the inner side of the vertical portion in such a manner that a groove for insertion of a member to be mounted is formed between the top surface of said first insulating rubber and the lower side of the horizontal portion, and a second insulating rubber attached to the top of the horizontal portion or to the top of the horizontal portion and the outer side of the vertical portion, said first and second insulating rubbers being softer than said anisotropic electric conductive rubber.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIGS. 1 and 2 are perspective views respectively showing anisotropic electric conductive rubber connectors according to the present invention, FIGS. 3(*a*), 3(*b*) and 3(*c*) illustrate the process of manufacturing the connector in FIG. 1, and FIG. 4 is a perspective view showing an example of a dot matrix type LCD.

DESCRIPTION OF THE PREFERRED EMBODIMENT

Figure 3A:
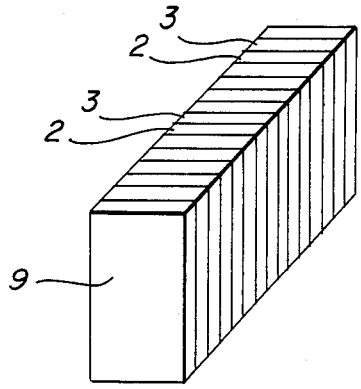
Figure 3B:
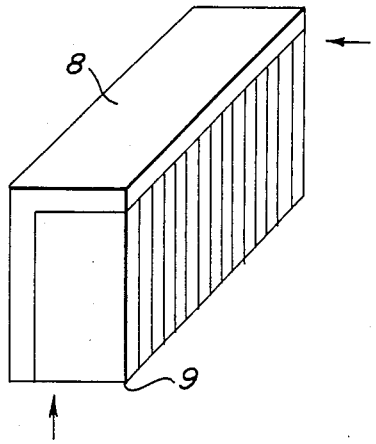
Figure 3C:
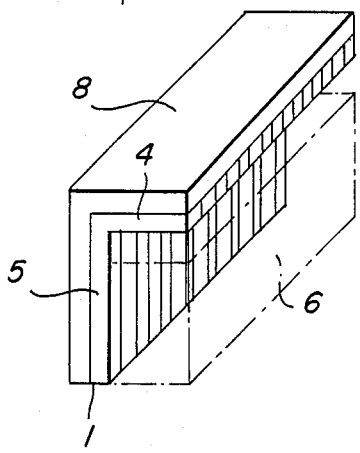

An embodiment of the present invention will be described in detail with reference to FIGS. 1 through 3. An anisotropic electric conductive rubber 1 comprises alternate conductive rubbers 2 containing electric conductive powders such as carbons, and insulating rubbers 3. The pitch of the conductive rubbers 2 (the interval between given two adjacent conductive rubbers 2) coincides with that of the connection terminals of a display device to be connected. The anisotropic electric conductive rubber 1 is of reversed L-shape comprising a horizontal portion 4 and a vertical portion 5. Both of these portions are made to be thick to the extent that the conductive rubbers 2 have a moderate resistance and that the edges of the components of the display device do not easily damage the rubbers.

A rectangular parallelopiped insulating rubber 6 is attached to the inner side of the vertical portion 5 of the anisotropic electric conductive rubber 1 in such a manner that a horizontal groove 7 for insertion of a member to be mounted is formed between the insulating rubber 6 and the horizontal portion 4. The width of the insertion groove 7 (distance between the upper face of the insulating rubber 6 and the lower face of the horizontal portion 4) is approximately the same as the thickness of a constituent member of the display device, or for example, the thickness of the glass plate of an LCD. An insulating rubber 8 is further attached to the outer surface of the anisotropic electric conductive rubber 1, covering the upper face of the horizontal portion 4 and the outer face of the vertical portion 5. Both of the insulating rubbers 6 and 8 are softer than the anisotropic electric conductive rubber 1 to effect that the connector as a whole has a lower hardness than the anisotropic electric conductive rubber 1. The insulating rubbers 6 and 8 may be made of, for example, silicone rubber. The insulating rubber 8 may cover only the upper face of the horizontal portion 4 as shown in FIG. 2.

Manufacturing process of the anisotropic electric conductive rubber connector in FIG. 1 will be described below with reference to FIG. 3.

First, the conductive rubbers 2 and the insulating rubbers 3 are alternately laid one on the other to make a laminate which is vulcanized under pressure and heated to form a rectangular parallelopiped block 9 (generally called zebra rubber). (See FIG. 3(*a*).) Then, the insulating rubber 8 is set on the top surface and on a lateral side surface (having a stripe pattern) of the block 9 by vulcanization forming. (See FIG. 3(*b*).) The block 9 is then cut parallel to the horizontal portion 4 of the insulating rubber 8 from the other lateral side surface, and parallel to the vertical portion 4 from the bottom of the block 9 to remove any unnecessary portion. (See FIG. 3(*c*).) Finally, the insulating rubber 6 is set to the inner side of the vertical portion 5 of the anisotropic electric conductive rubber 1 by vulcanization forming. (See alternate-dot-and-dash line in FIG. 3(*c*).)

The insulating rubbers 6 and 8 may be attached to the anisotropic electric conductive rubber 1 by appropriate adhesive means. The manufacturing process for the anisotropic electric conductive rubber connector in FIG. 2 is the same as above.

An example of a high precision, large capacity LCD to which the connector of the present invention is applied is a dotmatrix type liquid crystal panel as shown in FIG. 4. This liquid crystal panel is composed of a segment side glass "b" having segment side connection terminals "a, . . . " and a common side glass "d" having common side connection terminals "c, . . . ".

While only certain embodiments of the present invention have been described, it will be apparent to those skilled in the art that various changes and modifications may be made therein without departing from the spirit and scope of the present invention as claimed.

What is claimed is:

1. An anisotropic electric conductive rubber connector, comprising:

an anisotropic electric conductive rubber formed in a reversed L-shaped and having integral horizontal and vertical portions, a first insulating rubber attached to the inner side of said vertical portion in such a manner to form an insertion groove which provides a space for inserting a member to be mounted between said first insulating rubber and the lower side of said horizontal portion of the anisotropic electric conductive rubber, and a second insulating rubber attached to the top surface of said horizontal portion, said first and second insulating rubber having a lower hardness than said anisotropic electric conductive rubber.

2. The connector of claim 1, wherein said anisotropic electric conductive rubber comprises alternate layers of conductive rubbers and insulating rubbers.

3. The connector of claim 1, wherein the width of said insertion groove is approximately the same as the thickness of a member of a device which is to be inserted into said insertion groove.

4. The connector of claim 3, wherein a dot matrix type liquid crystal panel is inserted into said insertion groove.

5. The connector of claim 1, wherein the first or second insulating rubbers are made of silicone rubber.

6. An anisotropic electric conductive rubber connector, comprising:

an anisotropic electric conductive rubber formed in a reversed L-shaped and having integral horizontal and vertical portions, a first insulating rubber attached to the inner side of said vertical portion in such a manner to form an insertion groove which provides a space for inserting a member to be mounted between said first insulating rubber and the lower side of said horizontal portion of the anisotropic electric conductive rubber, and a second insulating rubber attached to the entire outer sides of the anisotropic electric conductive rubber including the horizontal and vertical portions, said first and second insulating rubber having a lower hardness than said anisotropic electric conductive rubber.

7. The connector of claim 6, wherein said anisotropic electric conductive rubber comprises alternate layers of conductive rubbers and insulating rubbers.

8. The connector of claim 6, wherein the width of said insertion groove is approximately the same as the thickness of a member of a device which is to be inserted into said insertion groove.

9. The connector of claim 8, wherein a dot matrix type liquid crystal panel is inserted into said insertion groove.

10. The connector of claim 6, wherein the first or second insulating rubbers are made of silicone rubber.

* * * * *